US009802407B2

(12) United States Patent
Kida

(10) Patent No.: US 9,802,407 B2
(45) Date of Patent: Oct. 31, 2017

(54) LIQUID DISCHARGE HEAD, LIQUID DISCHARGE DEVICE, AND LIQUID DISCHARGE APPARATUS

(71) Applicant: Hitoshi Kida, Kanagawa (JP)

(72) Inventor: Hitoshi Kida, Kanagawa (JP)

(73) Assignee: RICOH COMPANY, LTD, Tokyo (JP)

( * ) Notice: Subject to any disclaimer, the term of this patent is extended or adjusted under 35 U.S.C. 154(b) by 0 days.

(21) Appl. No.: 14/939,053

(22) Filed: Nov. 12, 2015

(65) Prior Publication Data

US 2016/0152025 A1 Jun. 2, 2016

(30) Foreign Application Priority Data

Nov. 27, 2014 (JP) ..... 2014-240564
Aug. 6, 2015 (JP) ..... 2015-156434

(51) Int. Cl.
*B41J 29/38* (2006.01)
*B41J 2/14* (2006.01)

(52) U.S. Cl.
CPC .. *B41J 2/14233* (2013.01); *B41J 2002/14491* (2013.01)

(58) Field of Classification Search
None
See application file for complete search history.

(56) References Cited

U.S. PATENT DOCUMENTS

| | | | | |
|---|---|---|---|---|
| 7,537,313 | B2 * | 5/2009 | Miyata | B41J 2/14233 347/50 |
| 2004/0001122 | A1 * | 1/2004 | Miyata | B41J 2/14233 347/68 |
| 2007/0008356 | A1 * | 1/2007 | Katoh | B41J 2/04581 347/10 |
| 2010/0188448 | A1 | 7/2010 | Kida | |
| 2011/0228006 | A1 | 9/2011 | Kida | |
| 2012/0069095 | A1 | 3/2012 | Kida et al. | |
| 2012/0212547 | A1 | 8/2012 | Takemoto et al. | |
| 2012/0229542 | A1 | 9/2012 | Kida | |
| 2014/0022305 | A1 | 1/2014 | Kida | |
| 2015/0029270 | A1 | 1/2015 | Takemoto et al. | |
| 2015/0070421 | A1 | 3/2015 | Kida | |

FOREIGN PATENT DOCUMENTS

| | | |
|---|---|---|
| JP | 10-006496 | 1/1998 |
| JP | 2004-074428 | 3/2004 |
| JP | 2006-272574 | 10/2006 |
| JP | 2009-154519 | 7/2009 |
| JP | 2011-136462 | 7/2011 |
| JP | 2012-171149 | 9/2012 |

* cited by examiner

*Primary Examiner* — Matthew Luu
*Assistant Examiner* — Tracey McMillion
(74) *Attorney, Agent, or Firm* — Cooper & Dunham LLP

(57) ABSTRACT

A liquid discharge head includes a plurality of nozzles to discharge a liquid; a plurality of pressure generators corresponding to the plurality of nozzles; a driver IC to output a drive waveform to each of the plurality of pressure generators; a substrate on which the driver IC is mounted; and a drive voltage supply wire to supply drive voltage to the plurality of pressure generators, disposed on the substrate. In plan view, the driver IC has a rectangular shape and at least part of the drive voltage supply wire crosses over a longer side of the driver IC.

18 Claims, 15 Drawing Sheets

LIQUID DISCHARGE HEAD, LIQUID DISCHARGE DEVICE, AND LIQUID DISCHARGE APPARATUS

CROSS-REFERENCE TO RELATED APPLICATIONS

The present application claims priority pursuant to 35 U.S.C. §119(a) from Japanese patent application numbers 2014-240564 and 2015-156434, filed on Nov. 27, 2014, and Aug. 6, 2015, the entire disclosure of each of which is incorporated by reference herein.

BACKGROUND

Technical Field

The present invention relates to a liquid discharge head, a liquid discharge device, and a liquid discharge apparatus.

Background Art

A liquid discharge head has an actuator substrate, on which are mounted a plurality of nozzles to discharge liquid droplets, a plurality of pressure generating means corresponding to each nozzle, and driver ICs to output drive waveforms to each of the plurality of pressure generating means.

The actuator substrate includes drive voltage supply wiring to supply drive voltage disposed along a longer side of the driver IC downwards, an input terminal disposed at an edge of a shorter side of the driver IC is connected to the drive voltage supply wire, and the drive voltage supply wire is connected via a connection wire (or lead-out wire) that crosses over the shorter side of the driver IC.

In the above disclosure, because a lead-out wire to connect the drive voltage supply wire and an external wire is disposed from the shorter side of the driver IC where many input/output terminals are disposed, a pattern width of the lead-out wire connecting to the drive voltage supply wire narrows, thereby making it difficult to secure the required current capacity for the drive voltage supply wire.

On the other hand, to extend the pattern width of the lead-out wire that connects the drive voltage supply wire and the external wire, the shorter side of the driver IC should be extended, resulting in a bigger driver IC.

SUMMARY

In one exemplary embodiment of disclosure, provided is an optimal liquid discharge head including a plurality of nozzles to discharge a liquid; a plurality of pressure generators corresponding to the plurality of nozzles; a driver IC to output a drive waveform to the plurality of pressure generators; a substrate on which the driver IC is mounted; and a drive voltage supply wire to supply drive voltage to each of the plurality of pressure generators, disposed on the substrate. In plan view, the driver IC has a rectangular shape and at least part of the drive voltage supply wire crosses over a longer side of the driver IC.

These and other objects, features, and advantages of the present invention will become apparent upon consideration of the following description of the preferred embodiments of the present invention when taken in conjunction with the accompanying drawings.

DETAILED DESCRIPTION

An example of a liquid discharge head 100 according to the present invention will be described with reference to FIGS. 1 through 4.

Figure 1:
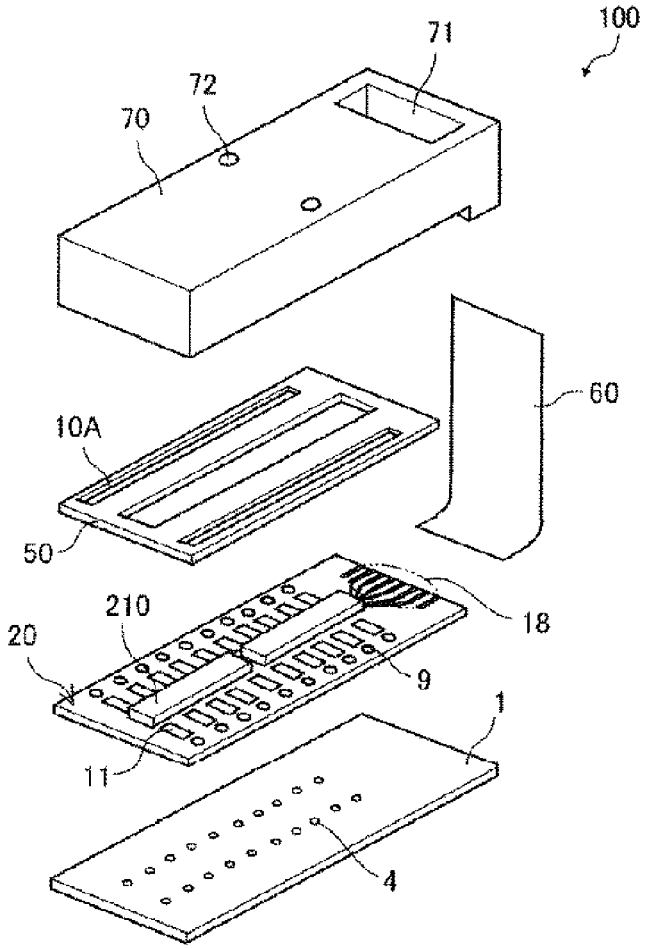
FIG. 1 is an exploded explanatory view of a liquid discharge head according to an embodiment of the present invention.
Figure 2:
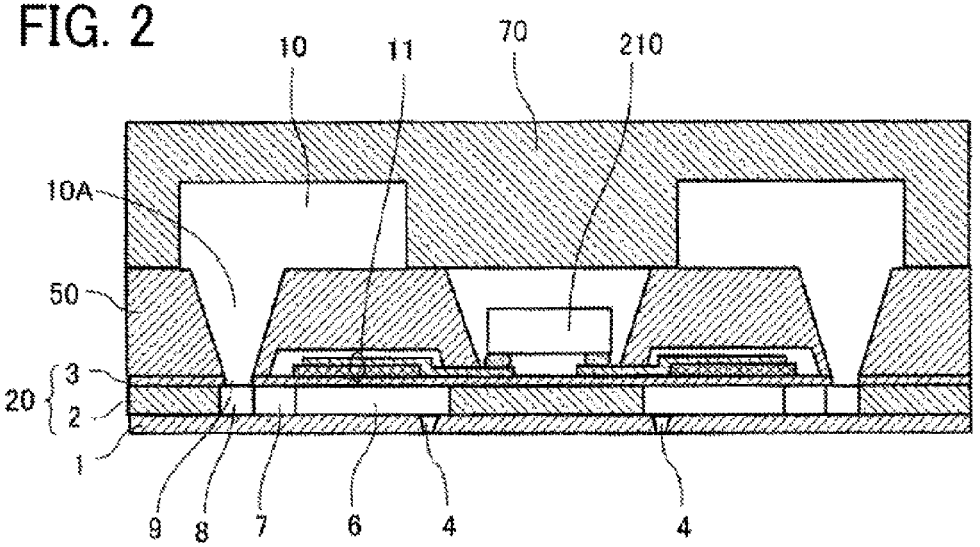
FIG. 2 is a cross-sectional view of the liquid discharge head of FIG. 1 along a direction perpendicular to a nozzle alignment direction.
Figure 3:
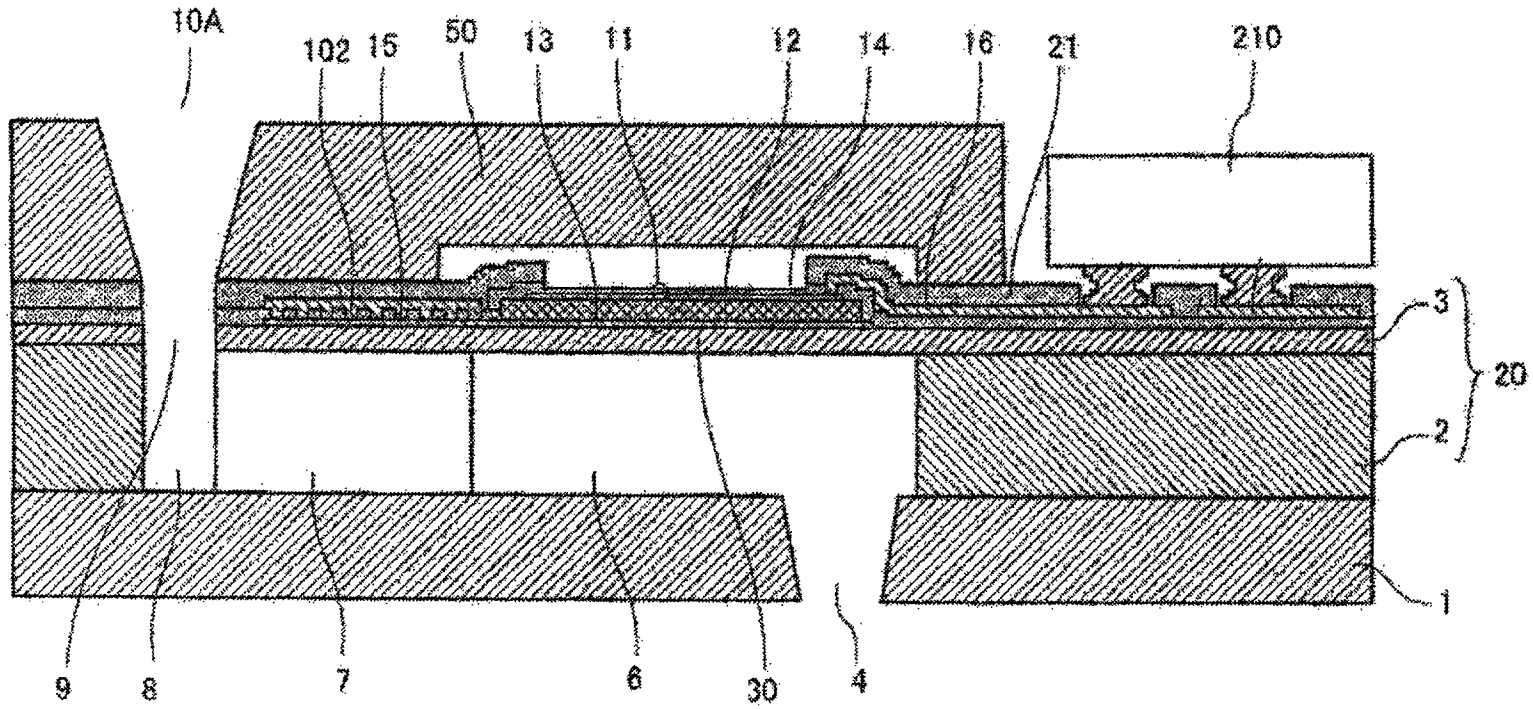
FIG. 3 is an enlarged cross-sectional view illustrating a main part of the liquid discharge head of FIG. 2.
Figure 4:
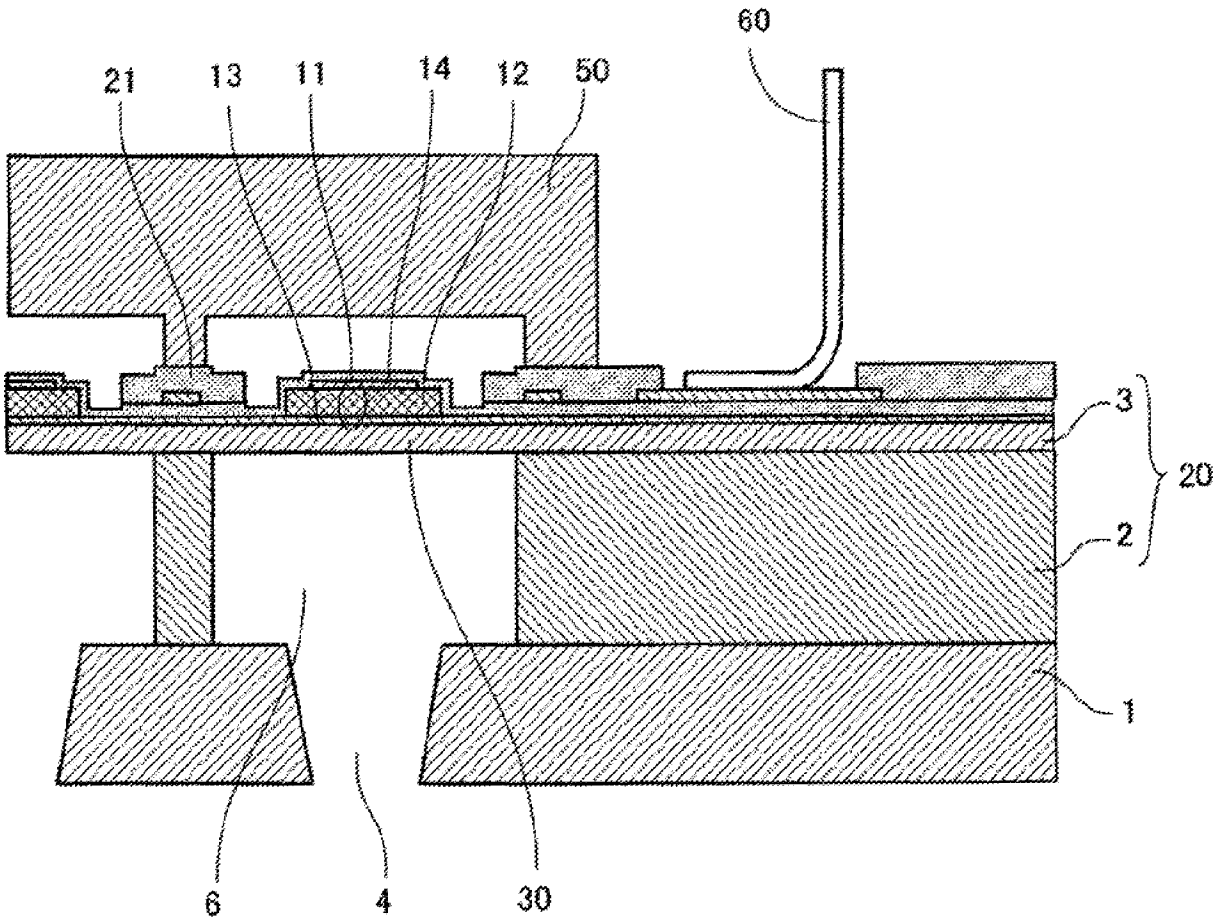
FIG. 4 is a cross-sectional view of the liquid discharge head of FIG. 2 along the nozzle alignment direction.

FIG. 1 is an exploded perspective view of the liquid discharge head, FIG. 2 is a cross-sectional view of the liquid discharge head along a direction perpendicular to a nozzle alignment direction, FIG. 3 is an enlarged cross-sectional view illustrating a main part of the same, and FIG. 4 is a cross-sectional view illustrating a main part of the same along the nozzle alignment direction.

The liquid discharge head 100 includes a nozzle plate 1, a channel plate 2, a diaphragm 3, a piezoelectric element 11 as a pressure generating means, a retaining substrate 50, and a frame 70 serving also as a common liquid chamber.

In the present embodiment, the channel plate 2, the diaphragm 3, and the piezoelectric element 11 form an actuator substrate 20.

A plurality of nozzles 4 that discharges liquid droplets is disposed on the nozzle plate 1. In the present embodiment, two nozzle arrays each including a plurality of nozzles 4 are disposed.

The channel plate 2 together with the nozzle plate 1 and the diaphragm 3 form an individual liquid chamber 6 that each nozzle 4 communicates with, a fluid resistor 7 that communicates with the individual liquid chamber 6, and a liquid inlet 8 that the fluid resistor 7 communicates with.

The liquid inlet 8 communicates with a common liquid chamber 10 formed by the frame 70, via a supply port 9 of the diaphragm 3 and an orifice manifold 10A, part of the common liquid chamber of the retaining substrate 50. The liquid is supplied to the common liquid chamber 10 of the frame 70 via a supply port 72 from outside.

The diaphragm 3 forms a deformable vibrating area 30 as part of the wall of the individual liquid chamber 6. The piezoelectric element 11 is disposed integrally with the vibrating area 30 on a surface opposite the individual liquid chamber 6 of the vibrating area 30 of the diaphragm 3, so that the vibrating area 30 and the piezoelectric element 11 form a piezoelectric actuator.

The piezoelectric element 11 is constructed of, from a side of the vibrating area 30, a lower electrode 13, a piezoelectric layer 12, and an upper electrode 14 sequentially laminated in this order. An insulation film 21 is formed on the piezoelectric element 11.

The lower electrode 13 serving as a common electrode for the plurality of piezoelectric elements 11 is connected to the common electrode wiring pattern 102 via a common electrode wire 15.

The upper electrode 14 as an individual electrode of the piezoelectric element 11 is connected to a driver IC 210 via an individual electrode wire 16.

The driver IC 210 is so mounted on the actuator substrate 20 as to cover an area between rows of piezoelectric elements 11 via flip chip bonding method.

As illustrated in FIG. 1, wires are led out from an input/output terminal of the I/O of the driver IC 210 mounted on the actuator substrate 20, or from an input terminal of the power source terminal and the drive waveform or signal, to a group of connection terminals 18.

Wiring member 60 such as FPC and FFC is electrically connected to each connection terminal of the group of connection terminals 18 via ACF connection, lead connection, and wire bonding, and another terminal of the wiring member 60 is connected to a controller disposed in the apparatus body.

The wiring member 60 is included in the frame 70, and is led out from a lead-out wire 71 to outside the head. In addition, each connection terminal of the group of connection terminals 18 is disposed at an end of the actuator substrate 20.

Then, the retaining substrate 50 that forms a concave vibration chamber 51 accommodating the piezoelectric element 11 is disposed on the actuator substrate 20. The retaining substrate 50 also forms part of the common liquid chamber 10 or the orifice manifold 10A. The retaining substrate 50 is bonded to a side of the diaphragm 3 of the actuator substrate 20 with an adhesive.

In the thus-configured liquid discharge head, electric voltage is applied from the driver IC 210 to a portion between the upper electrode 14 and the lower electrode 13 of the piezoelectric element 11, so that the piezoelectric layer 12 expands in a direction where the electrodes are layered, that is, in a direction of the electric field, and shrinks in a direction parallel to the vibrating area 30.

At this time, because the lower electrode 13 is retained by the vibrating area 30, tensile force is generated in a side of the lower electrode 13 of the vibrating area 30. As a result, the vibrating area 30 is bent toward the individual liquid chamber 6 and the liquid inside the individual liquid chamber 6 is pressurized, so that the liquid is discharged from the nozzle 4.

Figure 5:
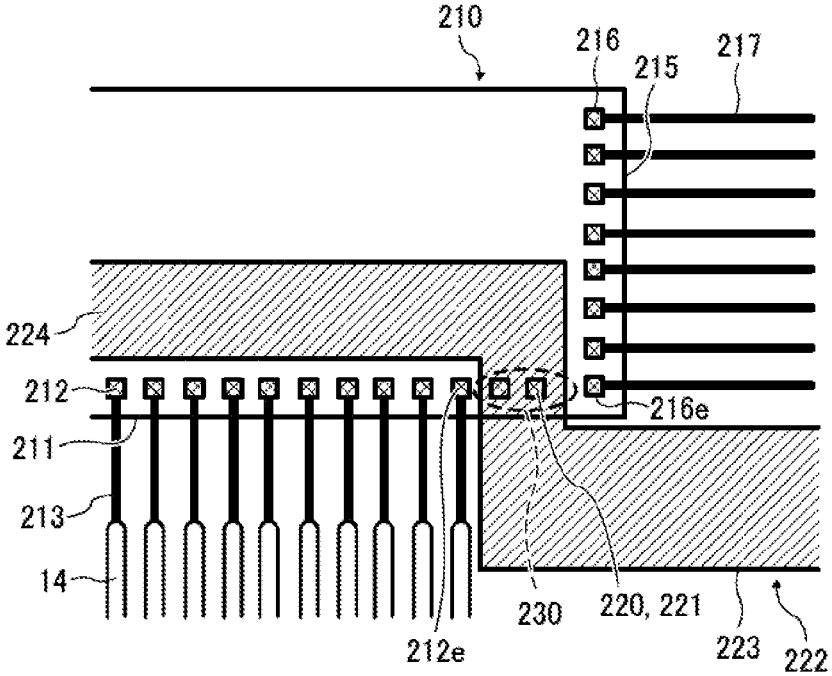
FIG. 5 is an explanatory plan view of a driver IC and its environment along a shorter side thereof on an actuator substrate according to a first embodiment of the present invention.

FIG. 5 is an explanatory plan view of a driver IC and its environment on an actuator substrate according to a first embodiment of the present invention. In the present and subsequent figures, the driver IC 210 is represented in a transparent state.

The driver IC 210 having a rectangular shape in plan view is flip-chip mounted on the actuator substrate 20.

Herein, drive voltage output terminals 212 to output a drive voltage or drive waveform to the piezoelectric element 11, are disposed in a longitudinal direction along a longer side 211 of the driver IC 210.

Each drive voltage output terminal 212 is connected to an individual electrode or upper electrode 14 via an individual electrode wire 213 (which is the same as the individual electrode wire 16). The individual electrode wire 213 applies a drive voltage to the piezoelectric element 11.

Terminals 216 serving as plural GND terminals for various signals and input/output (I/O) terminals are disposed along a shorter side 215 of the driver IC 210. Various signals, including data signals, shift clock signals, latch signals, and droplet size selection signals, are sent to the plurality of terminals 216 via the wiring member 60 through wires 217.

On the other hand, a drive voltage supply wire 222 to supply a drive voltage to the piezoelectric element 11 is disposed on the actuator substrate 20. At least part of the drive voltage supply wire 222 crosses over the longer side 211 of the driver IC 210. In the present embodiment, the entire drive voltage supply wire 222 crosses over the longer side 211 of the driver IC 210.

Note that the drive voltage supply wire herein means a wire to supply the voltage to drive the pressure generating means and herein to supply the drive voltage to the piezoelectric element 11. Crossover state means that an external profile of the drive voltage supply wire 222 crosses over the longer side 211 of the driver IC 210. Accordingly, in plan view, the drive voltage supply wire 222 entirely positions below the driver IC 210.

Below the driver IC 210, the drive voltage supply wire 222 includes a wire 224 disposed in the longitudinal direction of the driver IC 210 (that is, the direction along the longer side 211), and a lead-out wire 223 leading to the wire 224.

In plan view, the wire 224 as a wiring pattern positions below the driver IC 210 and connects to the drive voltage input terminal 220 of the driver IC 210. In the present embodiment, the wire 224 positions at an inner side of the driver IC 210 in plan view.

The lead-out wire 223 as a wiring pattern connecting to the wiring member 60 leading to an upper power source to drive the piezoelectric element, and positions outside the outer profile of the driver IC 210 in plan view.

Herein, an area 230 that extends a distance of more than two terminals is disposed between an extreme end drive voltage output terminal 212*e* in the longitudinal direction among the plural drive voltage output terminals 212 of the driver IC 210 and an extreme end terminal 216*e* among the terminals 216 on the driver IC 210 side and the actuator substrate 20 side. The drive voltage supply wire 222 passes through the area 230, so that the drive voltage supply wire 222 can cross over the longer side 211 of the driver IC 210.

In the present embodiment, a drive voltage supply terminal 221 connecting to the drive voltage supply wire 222 that passes through the area 230 is disposed on the actuator substrate 20 side, and the corresponding drive voltage input terminal 220 is disposed on the driver IC 210 side, thereby connecting the supply terminal 221 to the input terminal 220. Alternatively, no terminal need be disposed in the area 230.

Specifically, in the edge of the longer side 211 of the driver IC 210, the area 230 includes the drive voltage input terminal 220 alone connecting to the drive voltage supply wire 222 near an edge of the shorter side 215.

In this case, the drive voltage input terminal 220 connecting to the drive voltage supply wire 222 of the driver IC 210 is disposed in the longitudinal direction along the longer side 211 and is not disposed in the crosswise direction along the shorter side 215.

In addition, the width of the area 230 in the longitudinal direction is preferably substantially more than 3 pitches to be capable of disposing two terminals at a same interval as that of the drive voltage output terminals 212. If the width of the area 230 in the longitudinal direction is too short, current capacity to be supplied to the drive voltage supply wire 222 is insufficient, thereby inducing wire breakage or a drive voltage decrease.

More preferably, the width of the area 230 in the longitudinal direction allows a space of more than a half the width of the drive voltage supply wire 222 disposed below the driver IC 210.

The input terminal 220 of the driver IC 210 can be disposed at a position nearest to the longer side 211 among the rows of terminals disposed on the side of the shorter side 215 of the driver IC 210 or the nearest to the longer side 211 of adjacent terminals, but preferably is not disposed along the rows of terminals of the shorter side 215 of the driver IC 210. When the drive voltage input terminal 220 of the driver IC 210 is disposed on the edge of the longer side 211 not the shorter side 215, the number of terminals disposed along the shorter side 215 can be reduced and the size of the driver IC 210 in the shorter side 215 can be reduced.

Figure 6:
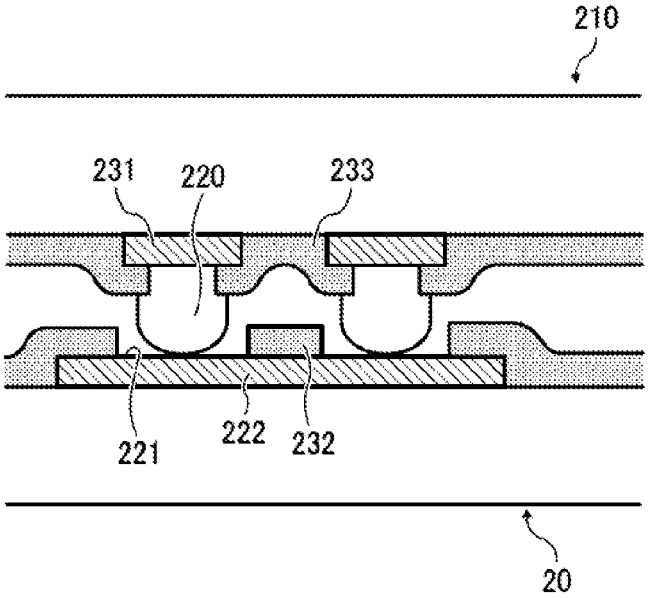
FIG. 6 is an explanatory cross-sectional view of a first example of a connection structure between a terminal of the actuator substrate and that of the driver IC.
Figure 7:
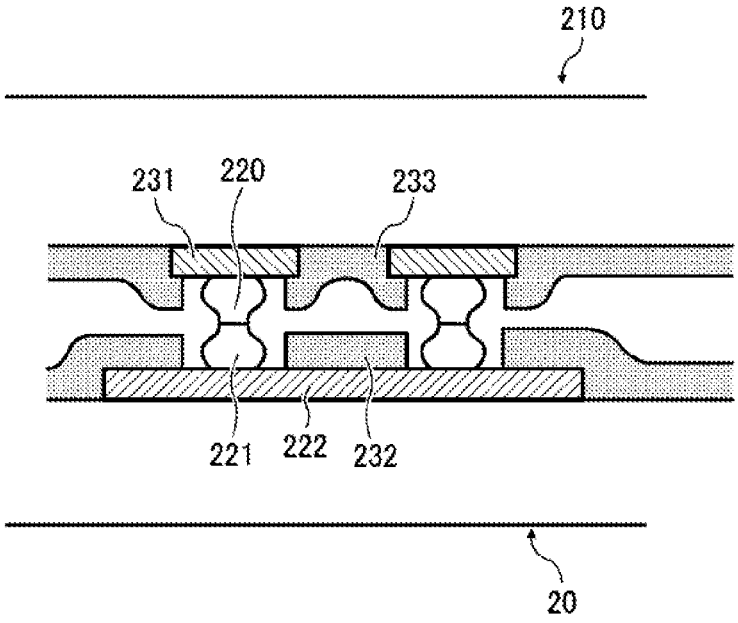
FIG. 7 is an explanatory cross-sectional view according to a second example of the connection structure between the terminal of the actuator and that of the driver IC.
Figure 8:
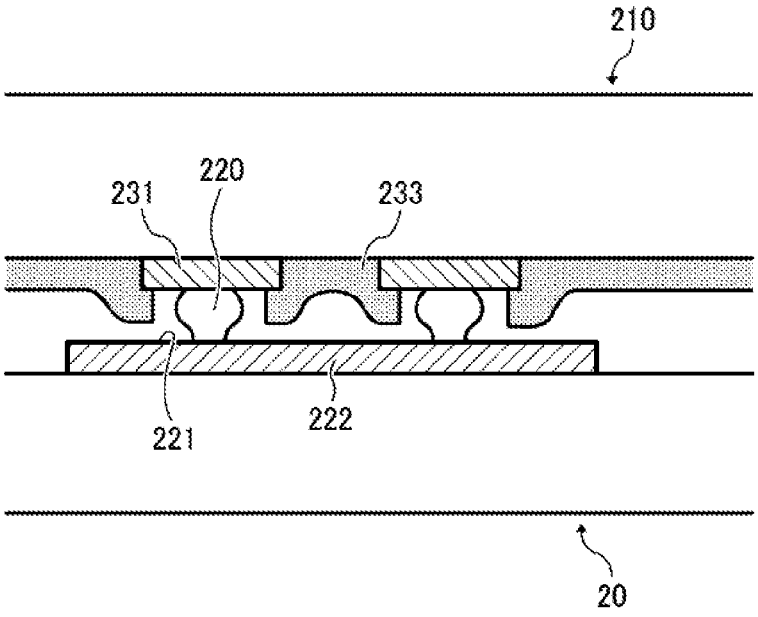
FIG. 8 is an explanatory cross-sectional view according to a third example of the connection structure between the terminal of the actuator and that of the driver IC.

Examples of different connection structures between the terminal of the actuator substrate and that of the driver IC will be described referring to FIGS. 6 to 8. FIGS. 6 to 8 are explanatory cross-sectional views of the area 230 in FIG. 5.

In the first example of FIG. 6, the drive voltage input terminal 220 is disposed on a pad 231 on the driver IC 210 side, and is formed of a metallic projection with coating and stud pump. In addition, part other than the drive voltage input terminal 220 is coated by an insulation film 233.

Part of the drive voltage supply wire 222 is not coated by an insulation film 232 and is open to connect to the drive voltage supply terminal 221 of the actuator substrate 20 side.

In the second example of FIG. 7, the drive voltage input terminal 220 is disposed on the pad 231 on the driver IC 210 side, and is formed of a metallic projection with coating and stud pump. In addition, a part other than the drive voltage input terminal 220 is coated by the insulation film 233.

Part of the drive voltage supply wire 222 is not coated by the insulation film 232, so that the drive voltage supply wire 222 formed with a metallic projection by coating and stud pump, is open to connect to the drive voltage supply terminal 221 of the actuator substrate 20 side.

In the third example of FIG. 8, the drive voltage input terminal 220 is disposed on the pad 231 on the driver IC 210 side, and is formed of a metallic projection with coating and stud pump. In addition, part other than the drive voltage input terminal 220 is coated by the insulation film 233.

The drive voltage supply terminal 221 on the actuator substrate 20 side is directly connected to an exposed surface of the drive voltage supply wire 222 formed of a conductor body itself.

As configured as above, a pattern width of the drive voltage supply wire 222 can be extended, so that the current capacity can be increased. Thus, a shorter side area of the driver IC 210 corresponding to the pattern width of the drive voltage supply wire 222 shrinks, so that the driver IC 210 does not increase in size.

Accordingly, while securing the current capacity to be supplied via the drive voltage supply wire, the driver IC can be prevented from becoming large in size.

Next, a second embodiment according to the present invention will be described with reference to FIG. 9.

Figure 9:
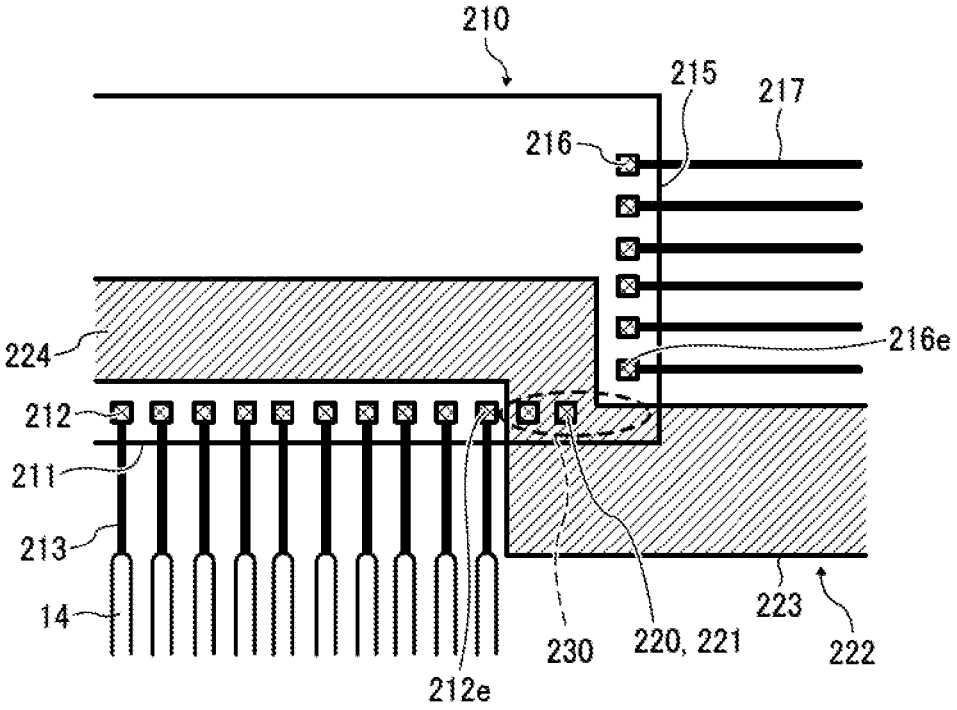
FIG. 9 is an explanatory plan view of a driver IC and its environment on an actuator substrate according to a second embodiment of the present invention.

FIG. 9 is an explanatory plan view of the driver IC near its shorter side on the actuator substrate according to the second embodiment of the present invention.

At least part of the drive voltage supply wire 222 crosses over the longer side 211 of the driver IC 210, and the rest of the drive voltage supply wire 222 crosses over the shorter side 215 of the driver IC 210.

As configured as above, the part that the drive voltage supply wire 222 crosses over the longer side 211 of the driver IC 210 need not be enlarged, and the pattern width of the drive voltage supply wire 222 can be extended.

Accordingly, while securing the current capacity of the drive voltage supply wire, the driver IC can be prevented from becoming large in size.

Next, referring to FIG. 10, a third embodiment of the present invention will be described.

Figure 10:
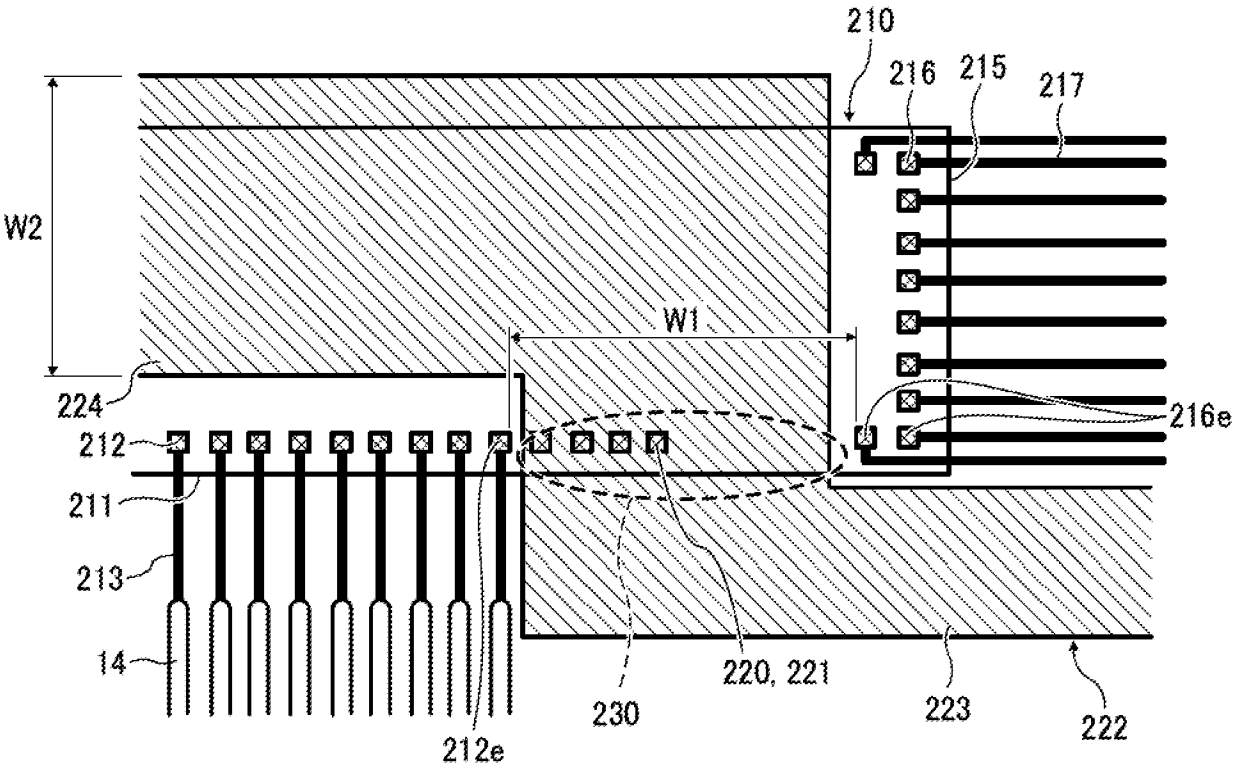
FIG. 10 is an explanatory plan view of a driver IC and its environment on an actuator substrate according to a third embodiment of the present invention.

FIG. 10 is an explanatory plan view of the driver IC near its shorter side on the actuator substrate according to the third embodiment of the present invention.

In the present embodiment, a width W1 of the area 230 in the longitudinal direction is set to longer than another width W2 of the wire 224 of the drive voltage supply wire 222.

As configured as above, the drive voltage supply wire 222 can be disposed without drastically reducing the pattern width thereof and more current capacity can be secured.

In the above embodiment, a case in which the plurality of drive voltage output terminals 212 is disposed along one of the longer sides 211 of the driver IC 210 is disclosed; however, the plurality of drive voltage output terminals 212 can be disposed along both of the longer sides 211.

Next, a fourth embodiment of the present invention will be described with reference to FIG. 11.

Figure 11:
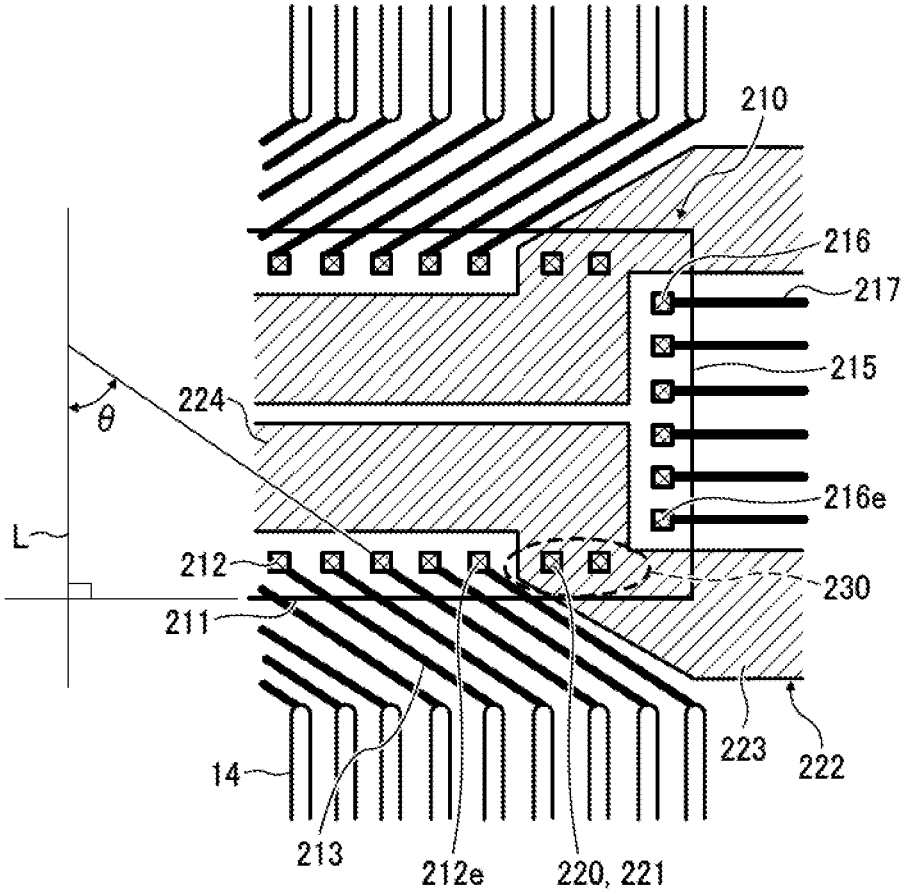
FIG. 11 is an explanatory plan view of a driver IC and its environment on an actuator substrate according to a fourth embodiment of the present invention.

FIG. 11 is an explanatory plan view of the driver IC near its shorter side on the actuator substrate according to the fourth embodiment of the present invention.

In the present embodiment, the individual electrode wire 213 to connect the drive voltage output terminals 212 of the driver IC 210 to the individual electrode 14 of the piezoelectric element 11 is disposed at an angle to relative to the longer side 211 of the driver IC 210.

Specifically, the individual electrode wire 213 is disposed with an angle θ which is greater than 0 degrees against a vertical line L relative to the longer side 211 of the driver IC 210 in plan view.

The lead-out wire 223 of the drive voltage supply wire 222 is disposed along the external profile of the individual electrode wire 213 at an edge in the longitudinal direction. In the present embodiment, part of the drive voltage supply wire 222 crosses over the longer side 211 of the driver IC 210, and the rest of the drive voltage supply wire 222 crosses over the shorter side 215 of the driver IC 210.

As configured as above, the width of the lead-out wire can be made wider, so that the distance between the pressure generating means and the drive voltage output terminal can be shortened while securing the current capacity, thereby enabling to make the head smaller.

Next, a fifth embodiment of the present invention will be described referring to FIG. 12.

Figure 12:
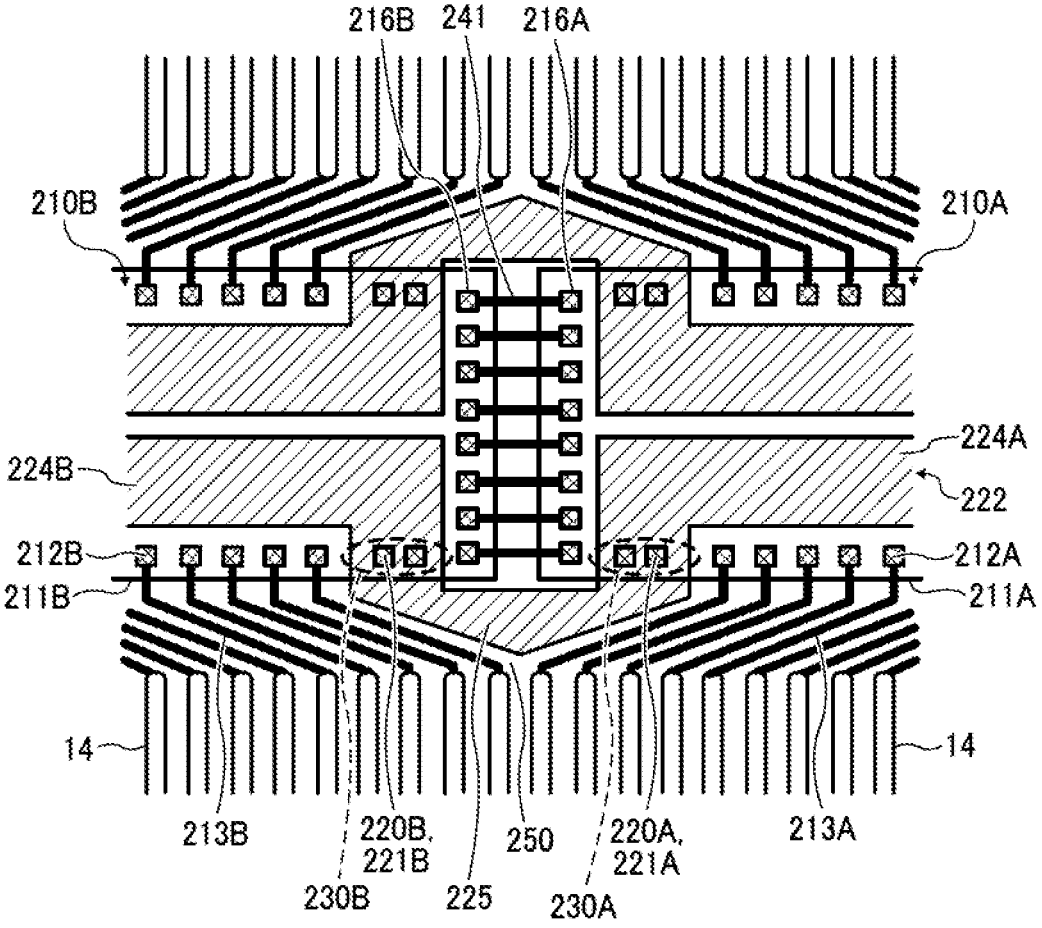
FIG. 12 is an explanatory plan view of a driver IC and its environment on an actuator substrate according to a fifth embodiment of the present invention.

FIG. 12 is an explanatory plan view of the driver IC near its shorter side on the actuator substrate according to the fifth embodiment of the present invention.

The present embodiment is applied to a portion between adjacent driver ICs.

Specifically, two driver ICs 210A, 210B are disposed side by side in the longitudinal direction on the actuator substrate 20. The driver IC 210A and the driver IC 210B are cascade-connected with each I/O terminal 216A or 216B connected by a wire 241. Also, the drive voltage input terminals 220A and 220B are disposed An individual electrode wire 213A from the driver IC 210A and an individual electrode wire 213B from the driver IC 210B are disposed at an angle relative to the longer sides 211A and 211B of the driver ICs 210A and 210B in plan view.

Herein, because the distance between each of the piezoelectric element 11 is the same, the individual electrode wire 213A and the individual electrode wire 213B are tilted in an inverse direction in a portion where the driver IC 210A and the driver IC 210B are adjacent in plan view, and the both wires approach in the individual electrode 14 side.

With this structure, a substantially triangular area 250 is formed in plan view by the individual electrode wire 213A and the individual electrode wire 213B of the adjacent driver ICs 210A and 210B.

Therefore, this area 250 includes the cross-link wire 225 to connect a wire 224A of the drive voltage supply wire 222 below the driver IC 210A to a wire 224B of the drive voltage supply wire 222 below the driver IC 210B.

With this structure, the wires 224A, 224B, and the cross-link wire 225 to connect these wires 224A, 224B, and the drive voltage supply wire 222 formed of the lead-out wire 223 cross over the longer sides 211A, 211B of the driver ICs 210A, 211B in the areas 230A, 230B.

The external shape of the cross-link wire 225 of the side of the individual electrode wire 213A or the individual electrode wire 213B is disposed at an angle relative to the longer sides 211A, 211B of the driver ICs 210A, 210 in plan view.

Accordingly, while securing the current capacity of the drive voltage supply wire, the driver IC can be prevented from becoming large in size.

Even though the distance between drive voltage output terminals is not equal at a link portion between adjacent driver ICs, the pressure generating means can be disposed with an equal pitch. With this structure, a high quality image can be formed without uneven printing. In addition, because the individual electrode wire can be disposed in a small wire area, a small apparatus can be formed with a low cost.

Next, a sixth embodiment according to the present invention will be described with reference to FIG. 13.

Figure 13:
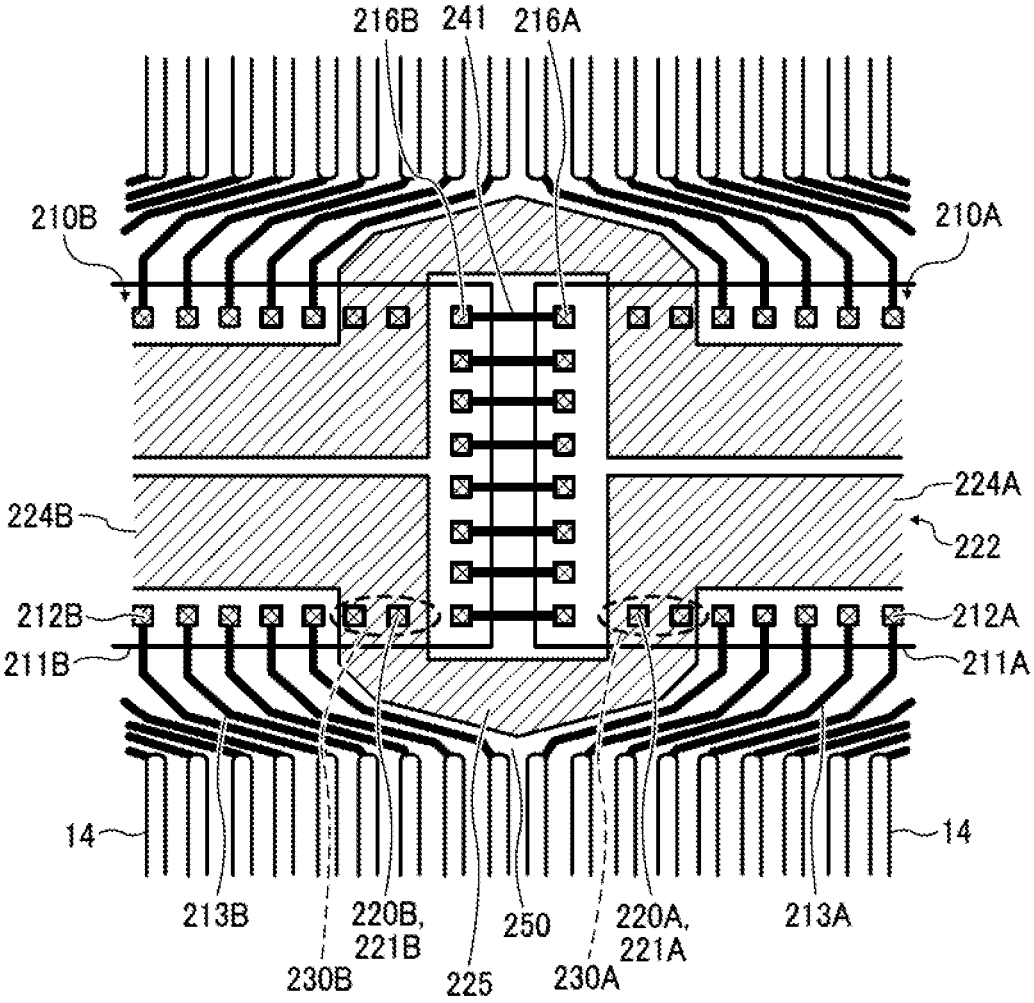
FIG. 13 is an explanatory plan view of a driver IC and its environment on an actuator substrate according to a sixth embodiment of the present invention.

FIG. 13 is an explanatory plan view of the driver IC near its shorter side on the actuator substrate according to the sixth embodiment of the present invention.

In the present embodiment, the individual electrode wires 213A, 213B are disposed bent in the mid of the drive voltage output terminals 212A, 212B and the individual electrode 14 in the fourth embodiment.

With this structure, the area 250 to accommodate the cross-link wire 225 can be widened, so that the pattern width of the cross-link wire 225 can be extended to thereby increase the current capacity.

The number of bending is at least once, but if the number of bending is more, effects are greater. The individual electrode wire can be curved not bent.

Next, referring to FIG. 14, a seventh embodiment of the present invention will be described.

Figure 14:
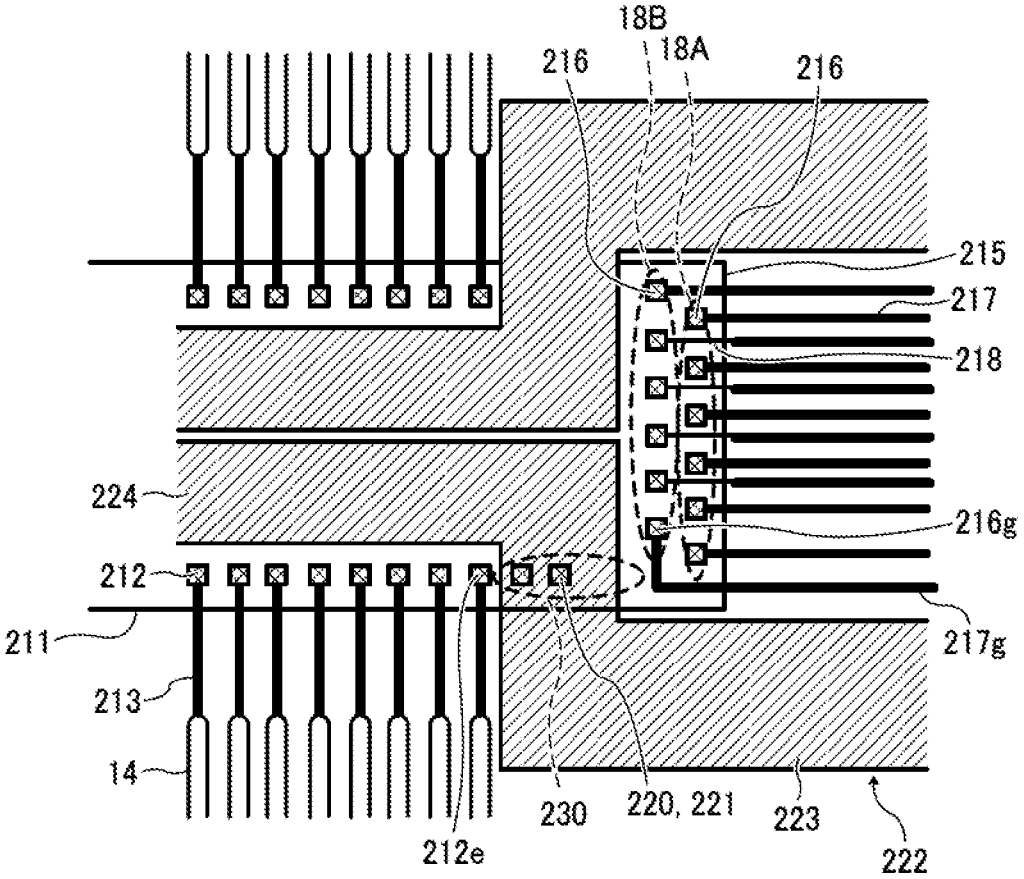
FIG. 14 is an explanatory plan view of a driver IC and its environment on an actuator substrate according to a seventh embodiment of the present invention.

FIG. 14 is an explanatory plan view of the driver IC near its shorter side on the actuator substrate according to the seventh embodiment of the present invention.

In the present embodiment, two rows of terminals 18A, 18B are disposed near the shorter side 215 of the driver IC 210 with respective rows at an outer side and inner side different positions in the longitudinal direction. A wire 217 is connected to each terminal 216 of the rows of terminals 18A, 18B.

Wiring to the inside row of terminals 18B of the driver IC 210 has a thin wire such as a wire 218 that passes between pads for connecting the outside row of terminals 18A.

Among the terminals 216 of the inside row of terminals 18B of the driver IC 210, terminals 216 that position at ends along the shorter side 215 of the driver IC 210 can include wider wiring without passing between the pads of the outside row of terminals 18A. Similarly, the wire to the outside row of terminals 18A can include wider wiring.

Thus, a terminal 216*g* that positions at an end in the shorter side among the inside row of terminals 18B of the driver IC 210 is made GND terminal, so that the GND wire 217*g* is positioned between the wire 217 to the other terminals 216 disposed in the shorter side direction of the driver IC 210 and the drive voltage supply wire 222.

The drive voltage supply wire 222 through which high power electric current passes is a noise source; however, because the GND wire 217*g* blocks the noise to the wire 217 to the other terminals 216 disposed in the shorter side of the driver IC 210, superposition of the noise to the wire 217 for other signals can be suppressed.

Figure 15:
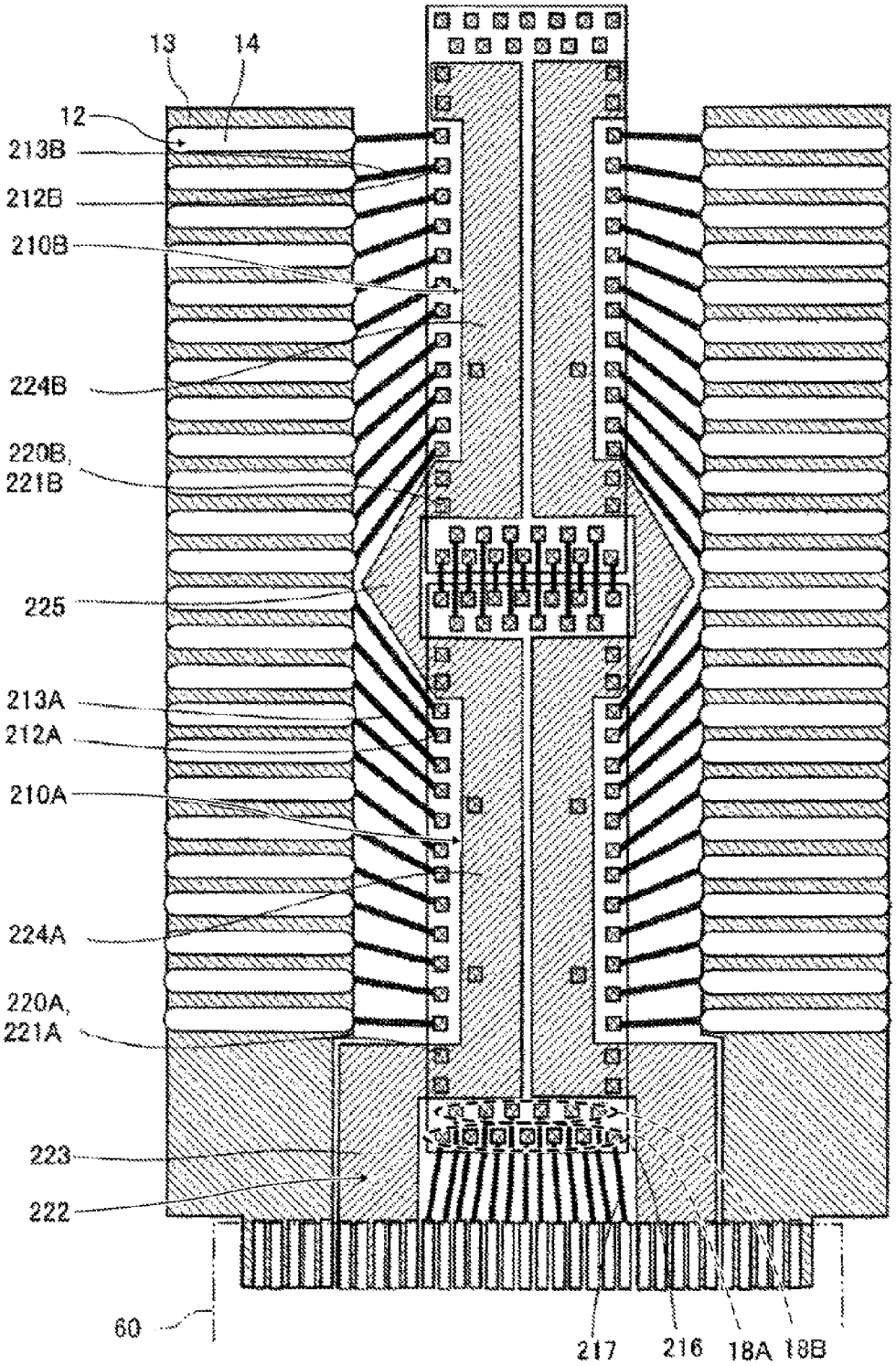
FIG. 15 is an explanatory plan view of a driver IC and its environment on an actuator substrate according to an eighth embodiment of the present invention.

Next, an eighth embodiment according to the present invention will be described with reference to FIG. 15. FIG. 15 is an explanatory plan view of a driver IC and its environment on an actuator substrate according to the eighth embodiment of the present invention.

The present eighth embodiment combines the first embodiment, the fifth embodiment, and the seventh embodiment. Each of the other embodiments may be combined on a consistent basis.

With this configuration, the same effect as that of each of the embodiments can be obtained.

Furthermore, in the present embodiment, the drive voltage supply terminals 221A, 221B are disposed not only in the area 230 as illustrated in FIG. 5, but in the area between the plurality of drive voltage output terminals 212A, 212B respectively disposed along the longer sides 211 on both sides of the driver IC 210.

As a result, because the drive voltage is supplied from the drive voltage supply wire 222 at plural positions in the alignment direction of the drive voltage output terminals, voltage difference due to the positions of the drive voltage output terminals may be reduced.

In each of the above description, a case in which the plurality of drive voltage output terminals 212 is disposed along both sides of the longer sides 211 of the driver IC 210 is explained; however, the plurality of drive voltage output terminals 212 can be dispose along one of the longer sides 211 alone.

Next, an example of the liquid discharge apparatus 200 according to the present invention will be described with reference to FIGS. 16 and 17.

Figure 16:
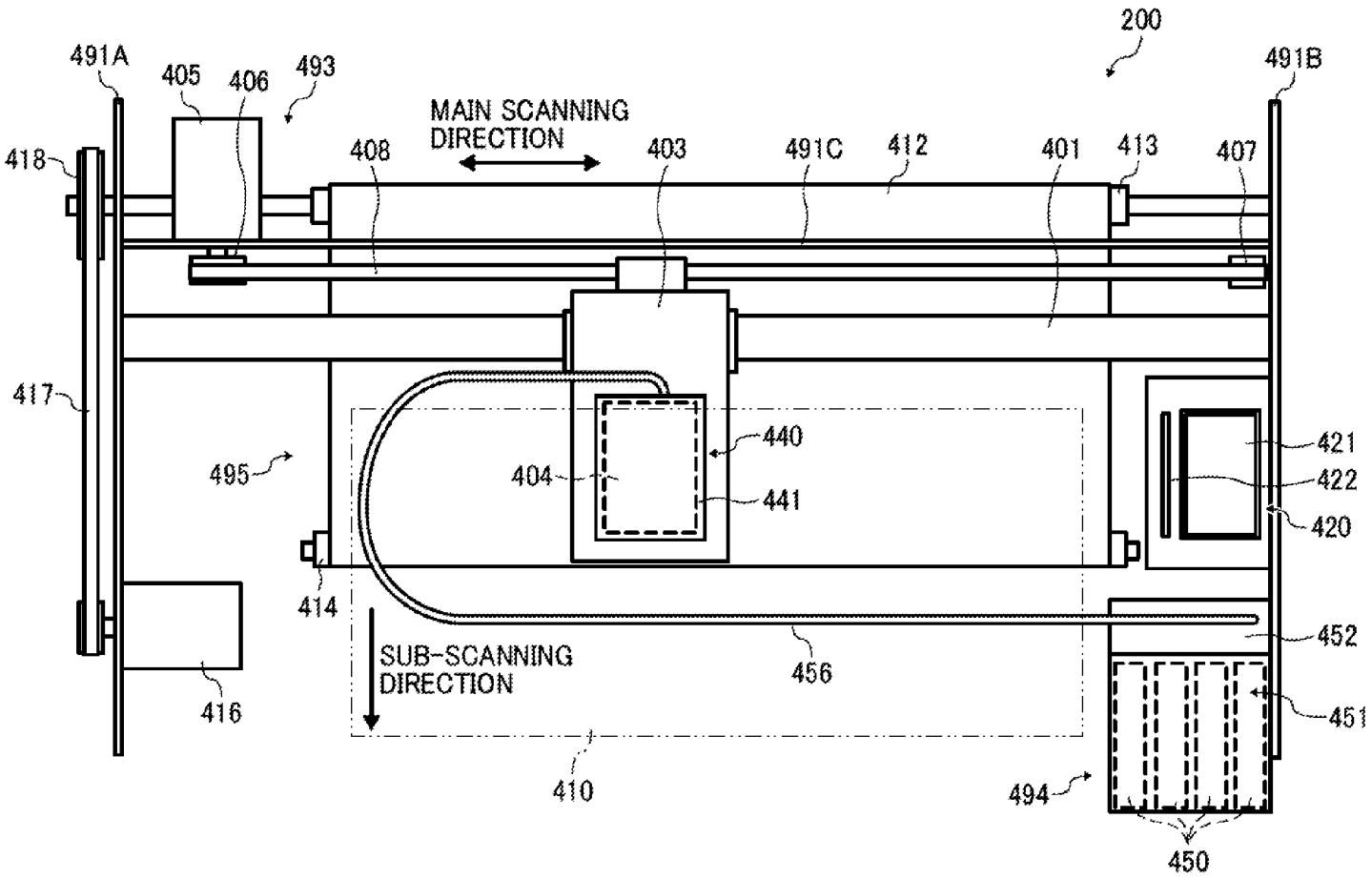
FIG. 16 is an exemplary liquid discharge apparatus illustrating a principle part thereof according to the embodiments of the present invention.
Figure 17:
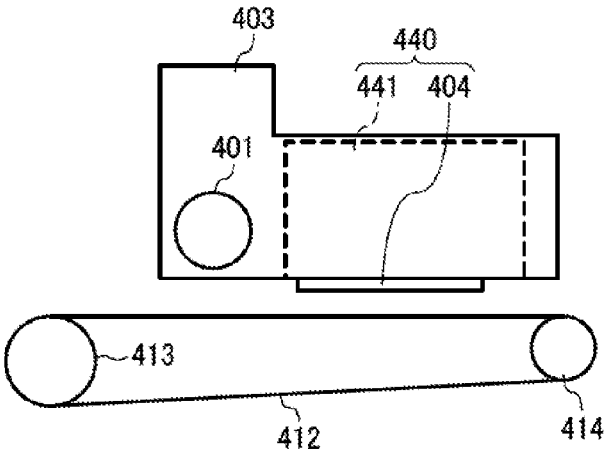
FIG. 17 schematically illustrates a side view of the liquid discharge apparatus of FIG. 16.

FIG. 16 is an explanatory plan view illustrating a principle part of the liquid discharge apparatus 200, and FIG. 17 is an explanatory side view of the same.

The present apparatus is a serial-type apparatus so that the carriage 403 reciprocally moves in a main scanning direction by a main scan moving unit 493. The main scan moving unit 493 includes a guide 401, a main scan motor 405, a timing belt 408, and the like. The guide 401 is held on right and left side plates 491A, 491B and supports the carriage 403 to be movable. The main scan motor 405 moves the carriage 403 reciprocally in the main scanning direction via a timing belt 408 stretched between a driving pulley 406 and a driven pulley 407.

A liquid discharge head 404 and a head tank 441 integrally form a liquid discharge device 440 that is mounted on the carriage 403. The liquid discharge head 404 of the liquid discharge device 440 discharges ink droplets of each color of yellow (Y), cyan (C), magenta (M), and black (K). The liquid discharge head 404 includes nozzle arrays formed of a plurality of nozzles 11 arranged in a sub-scanning direction perpendicular to the main scanning direction, with the discharging head oriented downward.

The liquid stored outside the liquid discharge head 404 is supplied to the liquid discharge head 404 via a supply unit 494 that supplies the liquid from a liquid cartridge 450 to the head tank 441.

The supply unit 494 includes a cartridge holder 451 to mount a liquid cartridge 450 thereon, a tube 456, and a liquid feed unit 452 including a feed pump. The liquid cartridge 450 is detachably attached to the cartridge holder 451. The liquid is supplied to the head tank 441 by the liquid feed unit 452 via the tube 456 from the liquid cartridge 450.

The present apparatus includes a conveying unit 495 to convey a sheet 410. The conveying unit 495 includes a conveyance belt 412, and a sub-scan motor 416 to drive the conveyance belt 412.

The conveyance belt 412 electrostatically attracts the sheet 410 and conveys it at a position facing the liquid discharge head 404. The conveyance belt 412 is an endless belt and is stretched between a conveyance roller 413 and a tension roller 414. The sheet 410 is attracted to the conveyance belt 412 due to an electrostatic force or by air aspiration.

The conveyance belt 412 is caused to rotate in the sub-scanning direction driven by a rotation of the conveyance roller 413 via a timing belt 417 and a timing pulley 418 driven by the sub-scan motor 416.

Further, a maintenance unit 420 to maintain the liquid discharge head 404 in good condition is disposed on the side of the conveyance belt 412 at one side in the main scanning direction of the carriage 403.

The maintenance unit 420 includes, for example, a cap member 421 to cap a nozzle face (i.e., a surface on which the nozzle is formed) of the liquid discharge head 404; a wiper 422 to clean the nozzle face, and the like.

The main scan moving unit 493, the supply unit 494, the maintenance unit 420, and the conveying unit 495 are disposed to a housing that includes side plates 491A, 491B, and a rear plate 491C.

In the thus-configured liquid discharge apparatus, a sheet 410 is conveyed on and attracted to the conveyance belt 412 and is conveyed in the sub-scanning direction by the cyclic rotation of the conveyance belt 412.

Then, the liquid discharge heads 404 are driven in response to image signals while the carriage 403 moving in the main scanning direction, and a liquid is discharged to the stopped sheet 410, thereby forming an image.

As a result, because the liquid discharge apparatus includes the liquid discharge head according to preferred embodiments of the present invention, a constantly high quality image is formed.

Next, another example of the liquid discharge device according to the present invention will be described with reference to FIG. 18.

Figure 18:
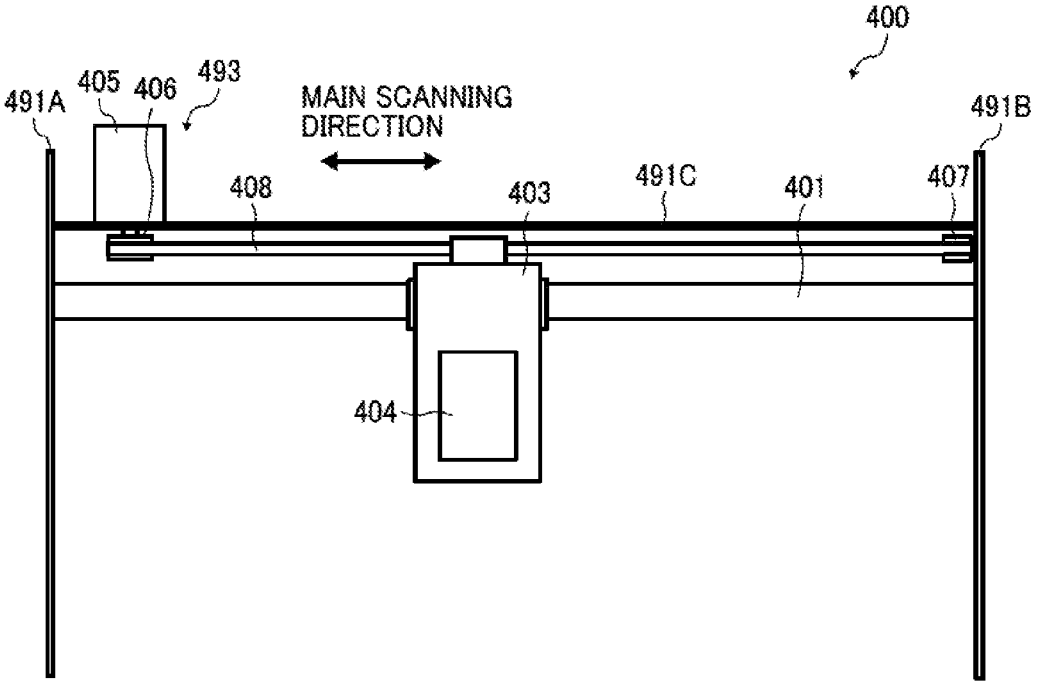
FIG. 18 is an example of a liquid discharge device illustrating a principle part thereof.

FIG. 18 is a plan view illustrating a principal part of the liquid discharge device 400.

The liquid discharge device 400 includes the side plates 491A, 491B and the rear plate 491C; the main scan moving unit 493; the carriage 403; and the liquid discharge head 404.

This liquid discharge device 400 further including at least one of the maintenance unit 420 disposed, for example, on the side plate 491B, and the supply unit 494, may also be configured as a liquid discharge device 400.

Next, another liquid discharge device according to the present embodiment will be described with reference to FIG. 19.

Figure 19:
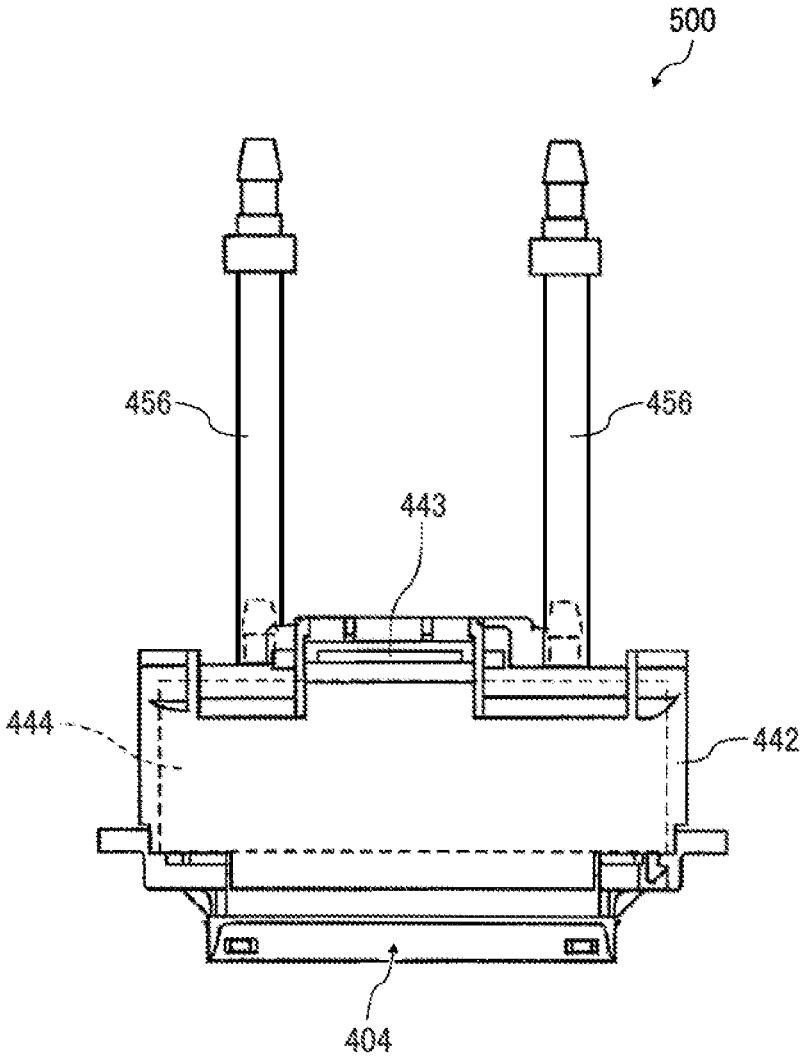
FIG. 19 is another example of a liquid discharge device including the liquid discharge head, a channel member, and tubes connected to the channel member according to the embodiment of the present invention.

FIG. 19 is a front view illustrating a principal part of the liquid discharge device 500.

The present liquid discharge device 500 includes the liquid discharge head 404 to which a channel member 444 is attached, and the tube 456 connected to the channel member 444.

Further, the channel member 444 is disposed inside a cover 442. Instead of the channel member 444, the liquid discharge device 500 may include the head tank 441. A connector 443 disposed above the channel member 444 electrically connects the liquid discharge head 404 with a power source.

In the embodiments of the present invention, the liquid discharge apparatus includes a liquid discharge head or a liquid discharge device, and drives the liquid discharge head to discharge a liquid. As the liquid discharge apparatus, there are an apparatus capable of discharging a liquid to materials on which the liquid can be deposited as well as an apparatus to discharge the liquid toward a space or liquid.

The liquid discharge apparatus may include devices to feed, convey, and discharge the material on which the liquid can be deposited. The liquid discharge apparatus may further include a pretreatment apparatus to coat a treatment liquid onto the material, and a posttreatment apparatus to coat the treatment liquid onto the material, onto which the liquid has been discharged.

Exemplary liquid discharge apparatuses may include, for example, an image forming apparatus to form an image on the sheet by discharging ink, and a three-dimensional apparatus to discharge a molding liquid to a powder layer in which powder material is formed in layers, so as to form a three-dimensional article.

In addition, the liquid discharge apparatus is not limited to such an apparatus to form and visualize images with letters or figures having meaning. Alternatively, the liquid discharge apparatus forms images without meaning such as patterns and three-dimensional objects.

The above materials on which the liquid can be deposited may include any material on which the liquid may be deposited even temporarily. Exemplary materials on which the liquid can be deposited may include paper, thread, fiber, fabric, leather, metals, plastics, glass, wood, ceramics, and the like, on which the liquid can be deposited even temporarily.

In addition, the liquid may include ink, a treatment liquid, DNA sample, resist, pattern material, binder, mold liquid, and the like.

Further, the exemplary liquid discharge apparatuses include, otherwise limited in particular, any of a serial-type apparatus to move the liquid discharge head and a line-type apparatus not to move the liquid discharge head.

The exemplary liquid discharge apparatuses include otherwise a treatment liquid coating apparatus to discharge the treatment liquid to the sheet to coat the treatment liquid on the surface of the sheet for the purpose of reforming a sheet surface, and an injection granulation apparatus in which a composition liquid including a raw materials dispersed in the solution is injected with the nozzle to granulate fine particles of the raw material.

The liquid discharge device is an integrated unit including the liquid discharge head and functional parts, or the liquid discharge head and other structures, and denotes an assembly of parts relative to the liquid discharge. For example, the liquid discharge device may be formed of a combination of the liquid discharge head with one of the head tank, carriage, supply unit, maintenance unit, and main scan moving unit.

Herein, examples of integrated unit include a liquid discharge head plus functional parts, of which structure is combined fixedly to each other through fastening, binding, and engaging, and ones movably held by the other parts. In addition, the liquid discharge head can be detachably attached to the functional parts or structures each other.

For example, an example of the liquid discharge device 440 as illustrated in FIG. 17 is integrally formed with the liquid discharge head and the head tank. Another example of the liquid discharge device is the integrally formed liquid discharge head and the head tank via the tube. A unit including a filter may further be added to a portion between the head tank and the liquid discharge head, thereby forming another liquid discharge device.

Further another example of the liquid discharge device is the liquid discharge head integrally formed with the carriage.

Still another example of the liquid discharge device includes the liquid discharge head movably held by the guide member that forms part of the main scan moving unit, so that the liquid discharge head and the main scan moving unit are integrally formed. Further, as illustrated in FIG. 18, the liquid discharge head, the carriage, and the main scan moving unit are integrally formed, thereby forming the liquid discharge device 400.

Furthermore, a cap member that forms part of the maintenance unit is fixed to the carriage on which the liquid discharge head is mounted, so that the liquid discharge head, the carriage, and the maintenance unit are integrally formed, thereby forming the liquid discharge device.

Further, the liquid discharge device 500 as illustrated in FIG. 19 includes the tube that is connected to the head tank or the channel member to which the liquid discharge head is attached, so that the liquid discharge head and the supply unit are integrally formed.

The main scan moving unit shall include a guide member itself. The supply unit shall include a tube itself, and a cartridge holder itself.

The pressure generating unit of the liquid discharge head is not limited in particular. For example, other than the piezoelectric actuator (or a layered-type piezoelectric element) as described above, a thermal actuator that employs thermoelectric conversion elements such as a thermal resistor, and an electrostatic actuator formed of a vibration plate and an opposed electrode may be used.

The term "image formation" means not only recording, but also printing, image printing, molding, and the like.

Additional modifications and variations of the present invention are possible in light of the above teachings. It is therefore to be understood that, within the scope of the appended claims, the invention may be practiced other than as specifically described herein.

What is claimed is:

1. A liquid discharge head comprising:

a plurality of nozzles to discharge a liquid;

a plurality of pressure generators corresponding to the plurality of nozzles;

a driver IC to output a drive voltage to the plurality of pressure generators;

a substrate on which the driver IC is mounted; and a drive voltage supply conductive pattern comprising a body bounded by (i) a first side of the drive voltage supply conductive pattern and (ii) a second side of the drive voltage supply conductive pattern, said first and second sides of the body extending in a longitudinal direction of the drive voltage supply conductive pattern, the drive voltage supply conductive pattern being configured to supply the drive voltage to each of the plurality of pressure generators, disposed on the substrate, wherein, in plan view, the driver IC has a rectangular shape and at least one of the first side and the second side of the body of the drive voltage supply conductive pattern crosses over a longer side of the driver IC.

2. The liquid discharge head as claimed in claim 1, wherein the driver IC includes a plurality of input terminals connecting to the drive voltage supply conductive pattern.

3. The liquid discharge head as claimed in claim 2, wherein the drive voltage supply conductive pattern includes a wire disposed at a position opposite the driver IC and extending along the longer side of the driver IC, and the wire and the plurality of input terminals are connected.

4. The liquid discharge head as claimed in claim 2, further comprising an area along an edge of the longer side of the driver IC that includes only the input terminal connecting to the drive voltage supply conductive pattern near an edge of a shorter side of the driver IC.

5. The liquid discharge head as claimed in claim 2, wherein the plurality of input terminals is disposed in a longitudinal direction along the longer side of the driver IC and is not disposed in a crosswise direction along a shorter side of the driver IC.

6. The liquid discharge head as claimed in claim 1, wherein at least two driver ICs are cascade-connected to the substrate; and a cross-link wire to connect two adjacent driver ICs is laid outside the longer side of the driver IC.

7. The liquid discharge head as claimed in claim 6, further comprising a drive voltage output wire to supply the drive voltage from the driver IC to the plurality of pressure generators, the drive voltage output wire disposed at an inclination angle relative to the longer side of the driver IC wherein the cross-link wire of the drive voltage supply conductive pattern is disposed at an area between the drive voltage output wires from the two adjacent driver ICs.

8. The liquid discharge head as claimed in claim 7, wherein the drive voltage output wire is bent along a long axis of the area in which the cross-link wire of the drive voltage supply conductive pattern is disposed.

9. The liquid discharge head as claimed in claim 1, further comprising plural rows of terminals disposed at different positions from each other in the longitudinal direction and near a shorter side of the driver IC, wherein:

a terminal at an end in a crosswise direction along the shorter side, among an inner row of terminals in the longitudinal direction of the driver IC, is a GND terminal; and a wire to the GND terminal is disposed between another wire to another terminal disposed along the crosswise direction and the drive voltage supply conductive pattern.

10. A liquid discharge device comprising the liquid discharge head as claimed in claim 1.

11. The liquid discharge device as claimed in claim 10, wherein the liquid discharge head is integrally formed with at least one of a head tank to store a liquid to be supplied to the liquid discharge head, a carriage to mount the liquid discharge head thereon, a supply unit to supply the liquid to the liquid discharge head, a maintenance unit to maintain the liquid discharge head, and a main scan moving unit to move the liquid discharge head in a main scanning direction.

12. A liquid discharge apparatus comprising the liquid discharge device as claimed in claim 10.

13. The liquid discharge head as claimed in claim 1, wherein a portion of the drive voltage supply conductive pattern is disposed below, and facing, the driver IC.

14. The liquid discharge head as claimed in claim 1 further comprising:

a plurality of individual electrode wires to connect the plurality of respective pressure generators to the drive voltage supply conductive pattern, wherein the drive voltage supply conductive pattern is connected to the driver IC, the individual electrode wires are connected to the respective pressure generators, and the drive voltage supply conductive pattern is connected to the plurality of individual electrode wires via the driver IC.

15. The liquid discharge head as claimed in claim 1, wherein the body of the drive voltage supply conductive pattern includes a first part extending in a longitudinal direction along the longer side of the driver IC and a second part extending in another direction along a shorter side of the driver IC, and the second part of the drive voltage supply conductive pattern crosses over the longer side of the driver IC.

16. A liquid discharge head comprising:

a plurality of nozzles to discharge a liquid;

a plurality of pressure generators corresponding to the plurality of nozzles;

a driver IC to output a drive voltage to the plurality of pressure generators;

a substrate on which the driver IC is mounted;

a drive voltage supply wire to supply the drive voltage to each of the plurality of pressure generators, disposed on the substrate, wherein, in plan view, the driver IC has a rectangular shape and an external profile of the drive voltage supply wire crosses over a longer side of the driver IC; and a drive voltage output wire to transmit the drive voltage from the driver IC to the plurality of pressure generators, the drive voltage output wire disposed at an inclination angle relative to the longer side of the driver IC, wherein the drive voltage supply wire is disposed to conform to the shape of the drive voltage output wire.

17. The liquid discharge head as claimed in claim 16, further comprising:

plural rows of terminals disposed at different positions from each other in the longitudinal direction and near the shorter side of the driver IC, wherein:

a terminal at an end in a crosswise direction along the shorter side, among an inner row of terminals in the longitudinal direction of the driver IC, is a GND terminal; and a wire to the GND terminal is disposed between another wire to another terminal disposed along the crosswise direction and the drive voltage supply wire.

18. A liquid discharge head comprising:

a plurality of nozzles to discharge a liquid;

a plurality of pressure generators corresponding to the plurality of nozzles;

a driver IC to output a drive voltage to the plurality of pressure generators;

a substrate on which the driver IC is mounted;

a drive voltage supply wire to supply the drive voltage to each of the plurality of pressure generators, disposed on the substrate; and plural individual electrode wires to connect the plurality of respective pressure generators to the drive voltage supply wire, wherein:

in plan view, the driver IC has a rectangular shape and at least part of the drive voltage supply wire crosses over a longer side of the driver IC;

the drive voltage supply wire is connected to the driver IC;

the plural individual electrode wires are connected to the respective pressure generators; and the drive voltage supply wire is connected to the plural individual electrode wires via the driver IC.

* * * * *